US005813567A

United States Patent [19]

Mangano

[11] Patent Number: 5,813,567

[45] Date of Patent: Sep. 29, 1998

[54] MOP BUCKET HAVING INTEGRAL MOP STABILIZING STRUCTURE

[76] Inventor: Joy Mangano, 49 Sunhill Rd., Nesconset, N.Y. 11767

[21] Appl. No.: 746,504

[22] Filed: Nov. 12, 1996

[51] Int. Cl.[6] ..... B65D 25/28

[52] U.S. Cl. ..... 220/735; 15/264; 220/730

[58] Field of Search ..... 220/736, 735; 15/264

[56] References Cited

U.S. PATENT DOCUMENTS

| | | | |
|---|---|---|---|
| 348,160 | 8/1886 | Goldsmith | 220/736 |
| 1,008,856 | 11/1911 | Mosher | 220/736 |
| 2,533,355 | 12/1950 | Comfort | 220/736 |
| 2,738,531 | 3/1956 | Gerosa | 15/264 |
| 3,756,451 | 9/1973 | Popeil | 15/264 |
| 4,722,113 | 2/1988 | Olsson | 15/264 |
| 5,201,439 | 4/1993 | Davis | 220/736 |
| 5,511,279 | 4/1996 | Ippolito | 220/735 |

*Primary Examiner*—Joseph M. Moy
*Attorney, Agent, or Firm*—Galgano & Burke

[57] ABSTRACT

A mop stabilizing structure for use in a mop bucket includes a notched shelf which is vertically positioned inside a mop bucket above the base and below the lip of the bucket. Preferably, the shelf is manufactured as an integral part of the mop bucket and has a tapered notch for accommodating a variety of mop types and sizes. In addition, according to the invention, the lower interior of the bucket is preferably provided with an anti-skidding surface which is also preferably integrally formed with the bucket. The invention may be applied in buckets having different sizes and shapes, is inexpensive to manufacture, and is simple to use.

8 Claims, 5 Drawing Sheets

MOP BUCKET HAVING INTEGRAL MOP STABILIZING STRUCTURE

BACKGROUND OF THE INVENTION

1. Field of the Invention

The invention relates to mop buckets. More particularly, the invention relates to a mop bucket which incorporates structure for stabilizing a mop in a substantially upright position.

2. State of the Art

Mops and mop buckets are well known in the art and the principal disadvantage of mop buckets is also well known. Mops generally have a relatively long handle relative to the height of a mop bucket. When a mop is placed in a mop bucket, the handle of the mop rests against the inner lip of the bucket at an angle relative to the vertical Depending on the size of the bucket and the weight of the mop handle, the inclination of the mop handle is likely sufficient to cause the mop to fall out of the bucket and/or cause the bucket to tip over and spill its contents. For this reason, during mopping operations, one must be careful when leaving a mop in a mop bucket. Despite the fact that this aspect of mop buckets is well known and the fact that good care is almost universally taken when leaving mops in buckets, in practice, mops fall out of buckets quite often during use. In fact, in many cases, it is simple impossible for a mop bucket to support a mop in a stable position regardless of the amount of care taken when leaving the mop in the bucket.

U.S. Pat. No. 3,756,451 to Popeil discloses a mop bucket having very specific dimensions and a U-shaped handle which incorporates a rotatable hook for supporting a mop handle. While the Popeil bucket may be effective in preventing spills, it requires careful construction, is limited to buckets having specific shapes and dimensions, requires moving parts, and is somewhat inconvenient to use. In order to support the mop in the bucket, the user must be sure that the U-shaped handle is raised to a vertical position and the rotatable hook is rotated into the proper position, a procedure which requires two hands. Removal of the mop from the bucket involves substantially the same careful attention.

U.S. Pat. No. 4,121,798 to Schumacher et al. discloses a "utensil handle holder" for holding the elongated handle of any of a variety of utensils in a generally vertical position. The holder includes a clip portion for grasping a handle and a pair of spaced apart flanges for attaching the holder to a container wall. While this utensil holder might be effective in stabilizing a mop in a bucket to prevent spills, it has several disadvantages. First, it must be carefully secured to the mop bucket, and in order to accomplish that, it must be properly dimensioned for a particular bucket. Second, the clip portion is designed to grasp the utensil handle with "resilient jaws". This requires that the user push the mop handle into the clip portion against the bias of the jaws. Unless the jaws are carefully matched to the mop handle, this operation could actually cause the bucket to tip over, cause the holder to disengage from the bucket, or simply fail to grasp the mop handle. Even in the best situation, it is probably advisable that two hands be used to stabilize the bucket while engaging and disengaging the mop handle from the holder.

U.S. Pat. No. 4,722,113 to Olsson discloses a mop handle stabilizer consisting of two parts: a first part which is attached to a mop handle and a second part which is attached to the wall of a mop bucket. The first part has a projection and the second part has a slot to receive the projection. The Olsson device has many apparent disadvantages. First, it requires careful permanent attachment to both the mop and the bucket. Second, the first part must be properly dimensioned for a particular mop handle. Third, in order to insert the first part into the second part, they must be carefully aligned. Fourth, additional devices are required for each mop used with a particular bucket. Fifth, the mounted location of the first part on the mop handle must correspond to the mounted location of the second part on the bucket. Thus, the mop may not be usable with second bucket having another second part attached to it if the dimensions of second bucket differ significantly from the dimensions of the first bucket.

SUMMARY OF THE INVENTION

It is therefore an object of the invention to provide structure for stabilizing a mop in a bucket.

It is also an object of the invention to provide a mop stabilizing structure which accommodates a variety of mop types and sizes.

It is another object of the invention to provide a mop stabilizer which is easy to use.

It is still another object of the invention to provide a mop stabilizer which is inexpensive to manufacture and is adaptable to a variety of buckets.

Another object of the invention is to provide a one-piece mop bucket incorporating integral mop stabilizing structure which accommodates a variety of mop types and sizes.

In accord with these objects which will be discussed in detail below, the mop stabilizing structure of the present invention includes a notched shelf which is vertically positioned inside a mop bucket above the base and preferably below the lip. Most advantageously, the shelf is manufactured as an integral part of the mop bucket and has a tapered notch for accommodating a variety of mop types and sizes. In addition, according to the invention, the lower interior of the bucket is preferably provided with an anti-skidding surface which is also preferably integrally formed with the bucket. The invention may be applied in buckets having different sizes and shapes, is inexpensive to manufacture, and is simple to use.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
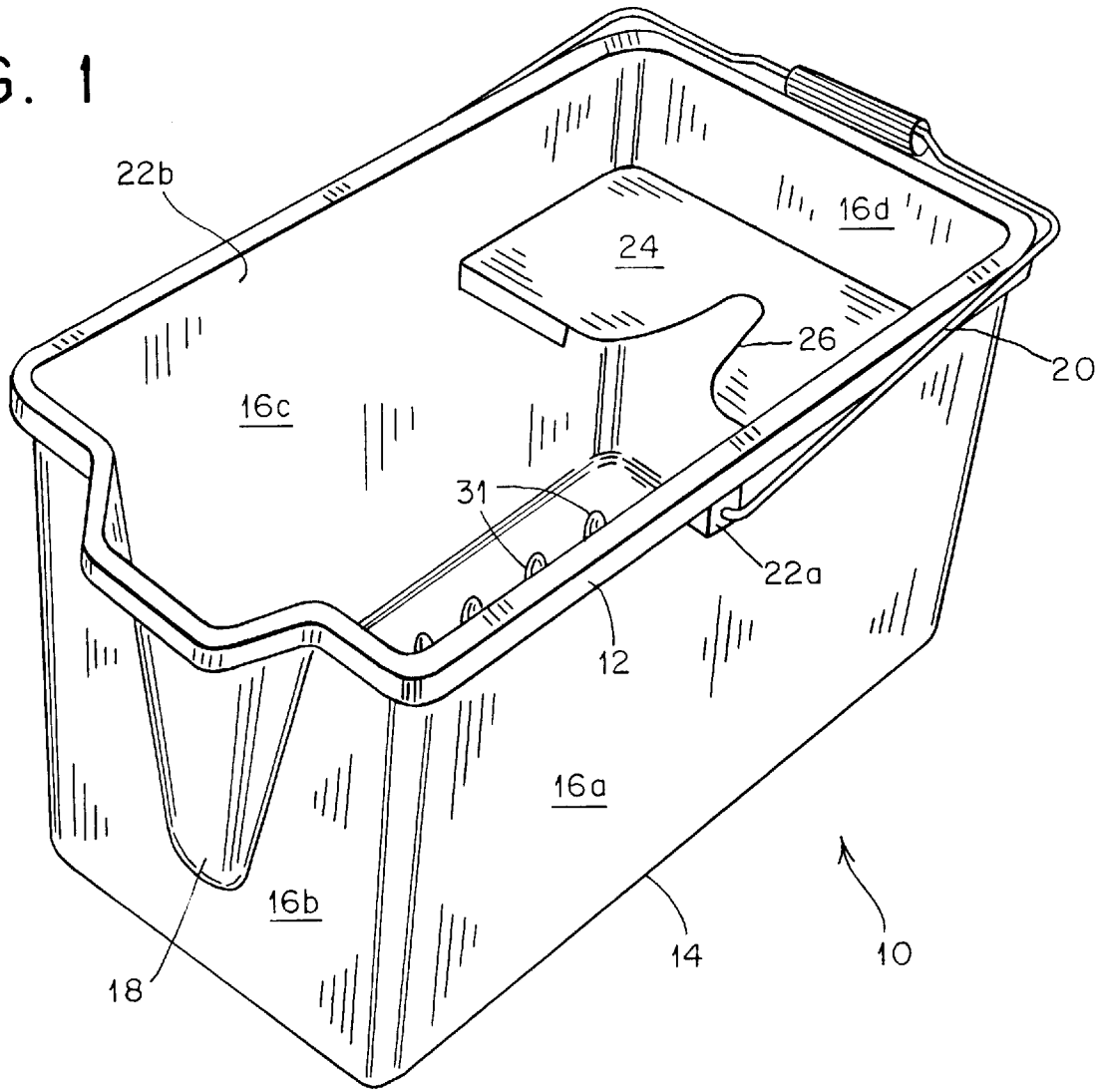
FIG. 1 is a perspective view of a first embodiment of a mop bucket incorporating mop stabilizing structure according to the invention.
Figure 2:
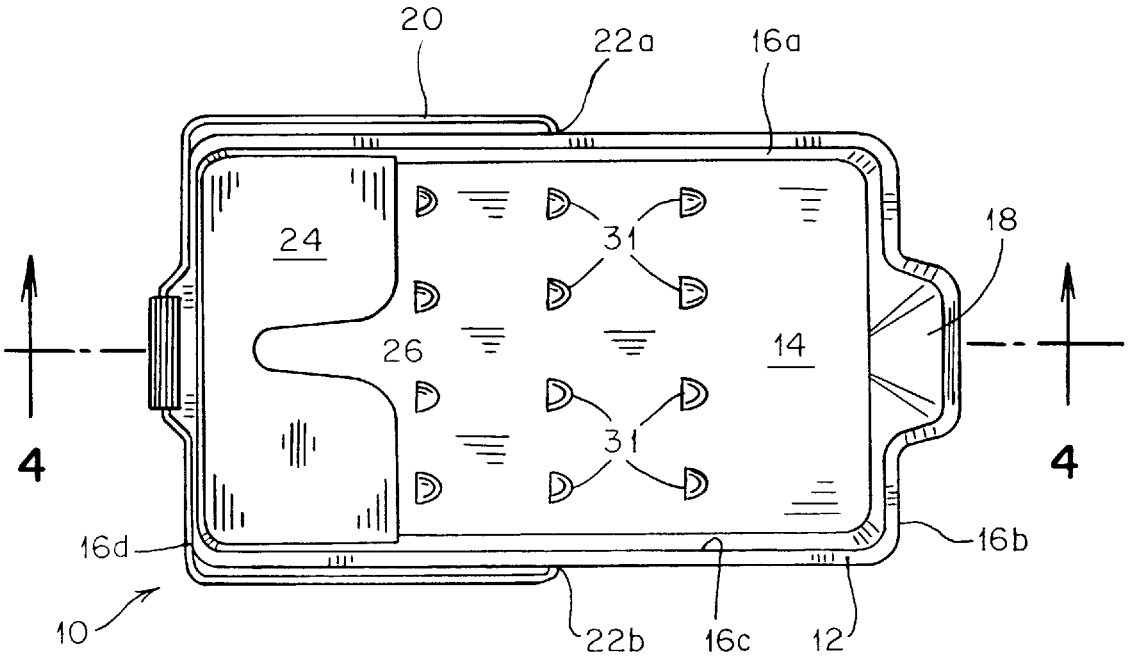
FIG. 2 is a plan view of the bucket of FIG. 1.
Figure 3:
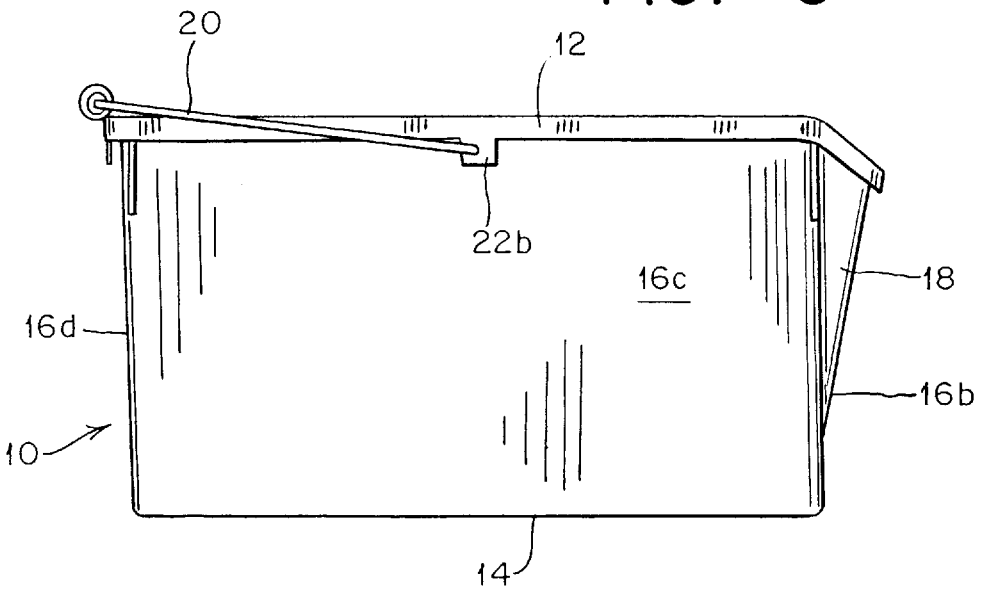
FIG. 3 is a side elevation view of the bucket of FIG. 1.
Figure 4:
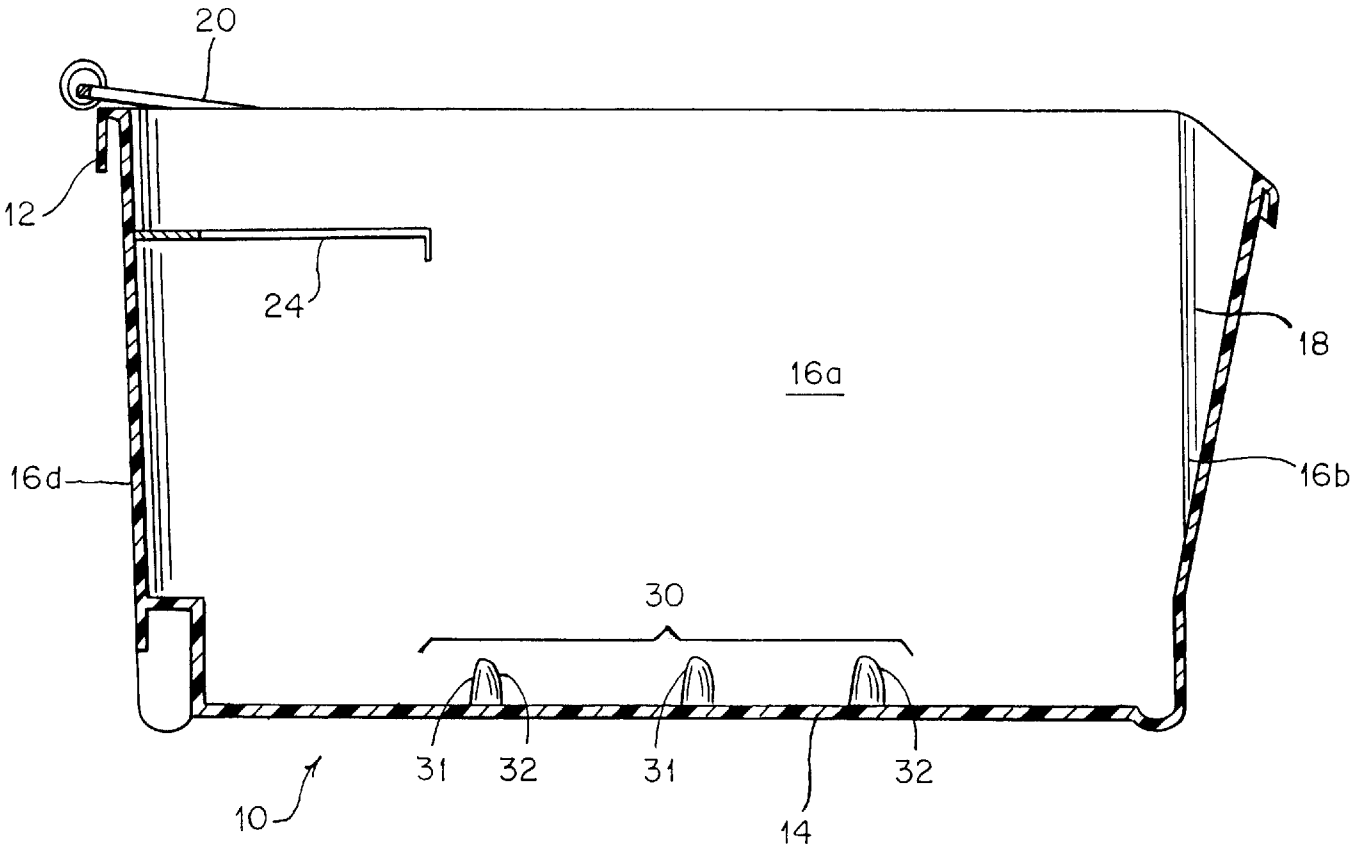
FIG. 4 is a sectional view taken along line 4—4 in FIG. 2.

Referring now to FIGS. 1 through 4, a rectangular-shaped mop bucket 10 according to a first embodiment of the invention resembles a conventional molded polyethylene bucket having an upper lip 12, a lower base 14, and side walls 16*a*–16*d*. As often conventional, the bucket 10 includes a spout 18 formed in a side wall, e.g. side wall 16*b* and a handle 20 which is hingedly attached to bosses 22*a*, 22*b* which are molded below the lip 12.

According to the invention, a mop supporting structure 24 is arranged adjacent to side walls 16*a*, 16*c*, and 16*d* below the lip 12 and above the base 14. As shown in FIGS. 1 through 4, the mop supporting structure 24 is embodied as a shelf which extends from side wall 16*d* toward the center of the bucket 10. The shelf 24 is provided with a central notch 26 which is preferably tapered in the direction toward the side wall 16*d*. In addition, and as seen best in FIGS. 2 and 4, an anti-skid structure 30 is preferably provided on the inner surface of the bucket base 14. According to this first embodiment, the anti-skid structure 30 includes a plurality of spaced-apart rows upwardly extending bosses or nipples, preferably generally in the form of a quadrant of a sphere with one flat side 31 facing the shelf 24 and an opposite arcuate spherical wedge-like side 32.

Figure 5:
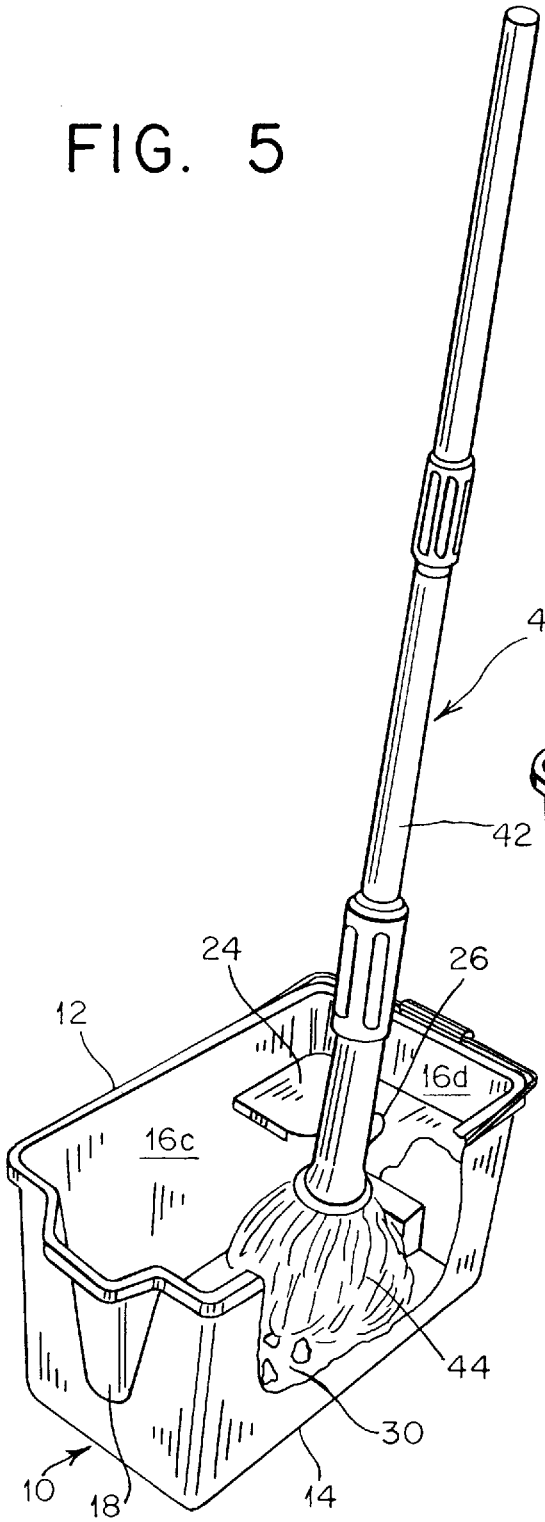
FIG. 5 is a cut away perspective view of the bucket of FIG. 1 with a string mop stabilized in an upright position.
Figure 6:
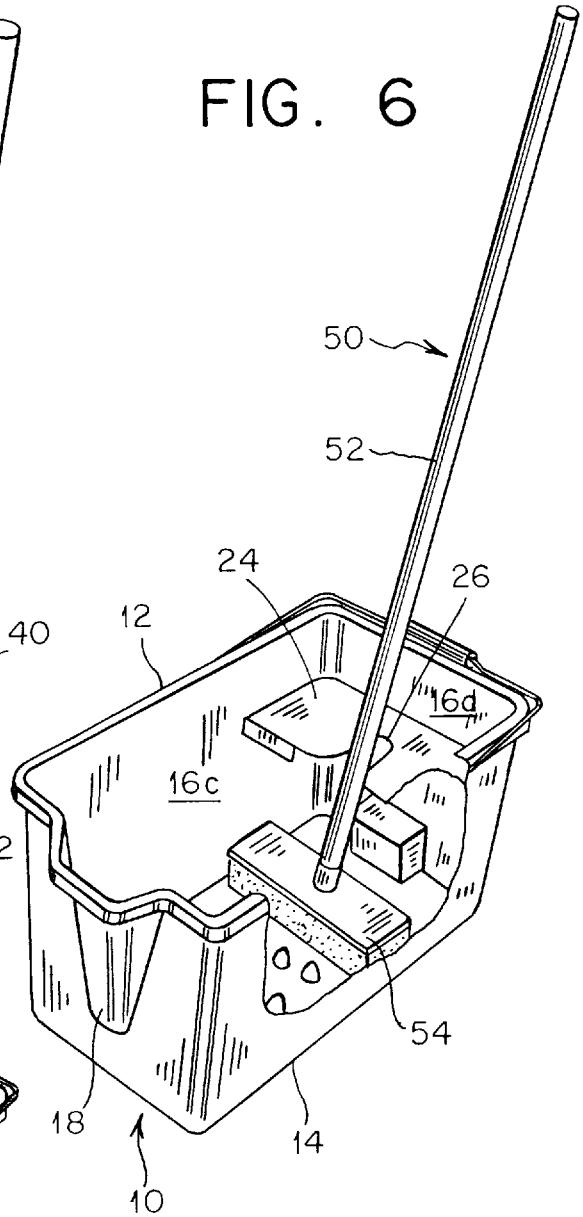
FIG. 6 is a cut away perspective view of the bucket of FIG. 1 with a sponge mop stabilized in an upright position.

From the foregoing and with reference to FIGS. 5 and 6, those skilled in the art will appreciate that the mop supporting structure 24 described above will effectively engage and maintain a mop handle in a substantially upright position to prevent the mop from falling out of the bucket 10 or from tipping the bucket over. Moreover, the anti-skid structure 30 will further engage the working end of a mop to prevent it from sliding across the base of the bucket, even under slippery soapy conditions. For example, as shown in FIG. 5, a string head mop 40 having a relatively large diameter handle 42 will be effectively engaged by the broad mouth of the tapered notch 26 in the shelf 24. Moreover, the stringy working end 44 of the mop 40 will be engaged by the raised nipples 30 on the inner surface of the base 14 of the bucket 10. Also, as shown in FIG. 6, the relatively smaller diameter handle 52 of a sponge mop 50 will be effectively engaged by the narrower part of the tapered notch 26 in the shelf 24. Moreover, the rectilinear working end 54 of the mop 50 will be engaged by the raised nipples 30 on the inner surface of the base 14 of the bucket 10.

As mentioned above, both the supporting structure 24 and the anti-skid structure 30 are preferably formed as an integral part of a one-piece mop bucket 10. However, a suitably dimensioned insertable structure could be fabricated for a "standard size" mop bucket.

From the foregoing, those skilled in the art will appreciate that the essential features of the invention include a mop handle supporting structure which extends inward from a side wall of a mop bucket and an anti-skid structure on the inner surface of the bucket base. As shown above, the supporting shelf structure 24 has an added feature of providing a resting place for scrub brushes, wash rags, soap, and the like. However, as will be shown below, a shelf structure is not necessary to support the mop handle. Furthermore, which the embodiment described above includes a rectilinear mop bucket, the invention can be applied to buckets of different shapes.

Figure 7:
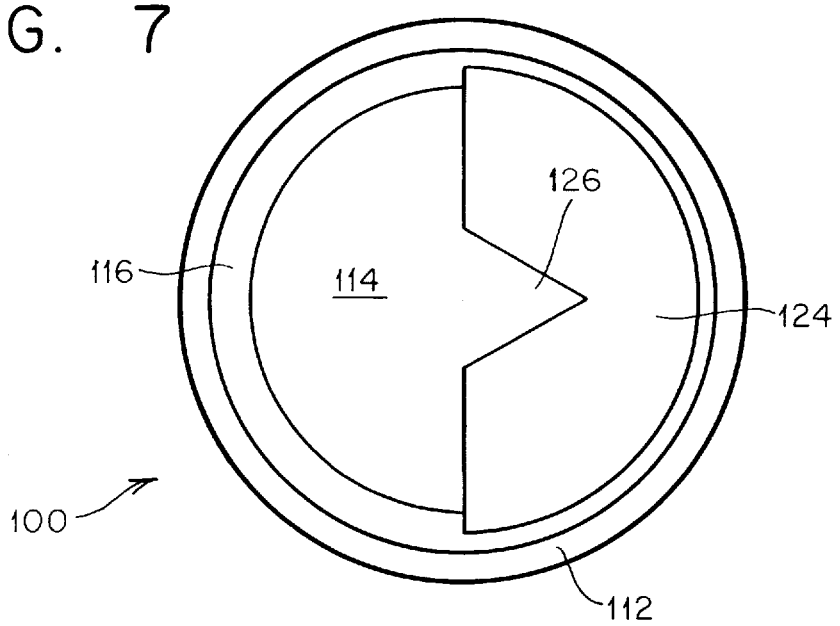
FIG. 7 is a plan view of a second embodiment of a mop bucket incorporating mop stabilizing structure according to the invention.

Turning now to FIG. 7, a frustroconical bucket 100 according to the invention has a circular upper lip 112, a circular base 114, and a single side wall 116. According to the invention, an arcuate shelf 124 with a tapered notch 126 is provided between the upper lip 112 and the base 114. It will be appreciated that the shelf 124 need not circumscribe a semi-circle or a continuous arc and may be formed as a notched chord.

Figure 8:
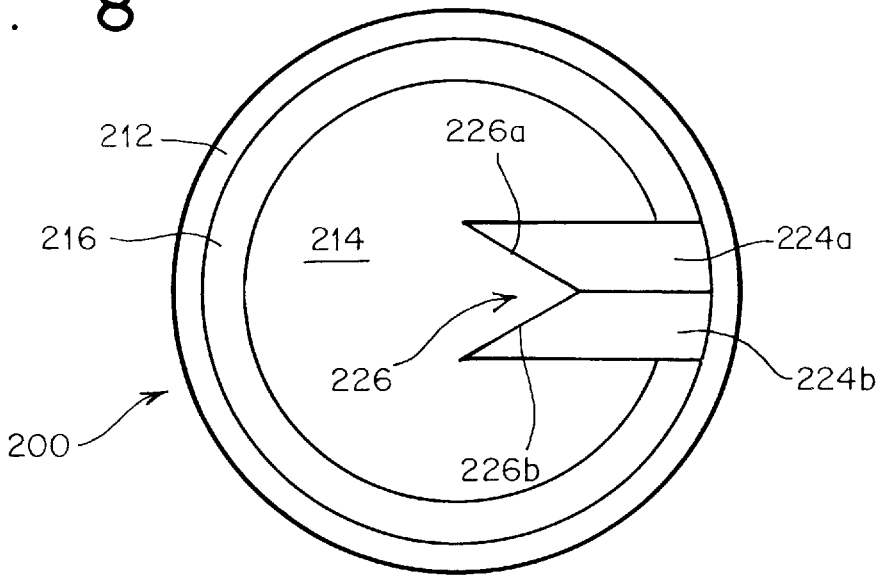
FIG. 8 is a plan view of a third embodiment of a mop bucket incorporating mop stabilizing structure according to the invention.

Referring now to FIG. 8, still another embodiment of a bucket 200 according to the invention has an upper lip 212, a lower base 214, a side wall 216, and a pair of supporting arms 224*a*, 224*b* which extend inwardly between the lip and the base. The arms each have a tapered end 226*a*, 226*b* which define a receiving well 226 for supporting a mop handle. It will also be appreciated that in lieu of a pair of arms, a single arm with a notched end could be utilized.

Figure 9:
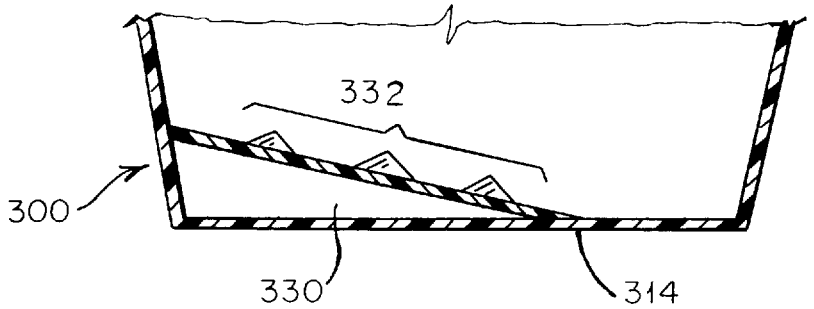
FIG. 9 is a broken transparent side elevation view of a fourth embodiment of a mop bucket incorporating mop stabilizing structure according to the invention.

As mentioned above, the mop supporting structure of the invention preferably includes an anti-skid structure. As described above, the anti-skid structure has been shown as a plurality of raised protrusions on the inner surface of the base of the bucket. However, the anti-skid structure may be formed in a number of different ways. For example, FIG. 9 shows a fourth embodiment of a mop bucket 300 wherein the anti-skid structure is a ramp 330 which has its lowest part under the mop arm support structure. Optionally, the ramp 330 may be provided with an additional ant-skid surface 332.

There have been described and illustrated herein several embodiments of a mop supporting structure for use in a mop bucket and buckets incorporating such structure. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A mop bucket, comprising:

a) an upper lip;

b) a lower base having an anti-skid structure on an inner surface of said base for engaging a mop head, said anti-skid structure comprising a plurality of raised protrusions;

c) at least one side wall between said upper lip and said lower base and defining a container; and d) a mop handle support member extending inward from said at least one side wall and having a notched end for engaging a mop handle, said support member being located above said base and below said lip.

2. A mop bucket according to claim 1, wherein said support member is a shelf.

3. A mop bucket according to claim 1, wherein said notch is tapered.

4. A mop bucket according to claim 3, wherein said support member is an arm.

5. A mop bucket according to claim 1, wherein said anti-skid structure includes a plurality of raised protrusions on said ramped surface.

6. A mop bucket according to claim 1, wherein said mop handle support member is formed as an integral part of said at least one side wall.

7. A mop bucket according to claim 1, wherein said anti-skid structure is formed as an integral part of said inner surface.

8. A mop bucket according to claim 1, wherein said support member is located below said lip.

* * * * *